US007735474B2

(12) United States Patent
Hardy

(10) Patent No.: US 7,735,474 B2
(45) Date of Patent: Jun. 15, 2010

(54) INJECTOR MOUNTING ARRANGEMENT

(75) Inventor: Martin P. Hardy, Kent (GB)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/726,482

(22) Filed: Mar. 22, 2007

(65) Prior Publication Data

US 2007/0221176 A1 Sep. 27, 2007

(30) Foreign Application Priority Data

Mar. 23, 2006 (EP) ..... 06251577

(51) Int. Cl.
*F02M 61/14* (2006.01)

(52) U.S. Cl. ..... 123/470

(58) Field of Classification Search ..... 123/445, 123/470, 456, 472, 495, 509, 468, 446, 469; 239/DIG. 12, 397, 132, 533.1, 533.11, 533.13, 239/600

See application file for complete search history.

(56) References Cited

U.S. PATENT DOCUMENTS

| | | | | |
|---|---|---|---|---|
| 1,834,058 | A | 12/1931 | Herr | |
| 3,334,617 | A | 8/1967 | Palkowsky | |
| 5,794,595 | A * | 8/1998 | Berger et al. | 123/470 |
| 6,009,856 | A * | 1/2000 | Smith et al. | 123/470 |
| 6,318,341 | B1 * | 11/2001 | Gmelin et al. | 123/470 |
| 6,431,152 | B1 * | 8/2002 | Estacio | 123/470 |
| 2002/0152995 | A1 * | 10/2002 | Kato | 123/470 |
| 2004/0040543 | A1 * | 3/2004 | Mickelson | 123/470 |
| 2004/0050365 | A1 * | 3/2004 | Reiter | 123/468 |
| 2004/0159311 | A1 * | 8/2004 | Anello et al. | 123/470 |
| 2004/0194764 | A1 * | 10/2004 | Okajima et al. | 123/469 |

FOREIGN PATENT DOCUMENTS

| | | |
|---|---|---|
| DE | 10340911 | 3/2006 |
| EP | 1262652 | 12/2002 |
| FR | 2875862 | 12/1931 |
| GB | 2177157 | 3/2005 |
| JP | 2000/120508 | 1/1987 |
| JP | 2001-65429 | 3/2001 |
| JP | 200165429 | * 3/2001 |
| JP | 2002-70695 | 3/2003 |
| JP | 200270695 | * 3/2003 |

OTHER PUBLICATIONS

Translation of Japanese Office Action dated Nov. 27, 2009.

* cited by examiner

*Primary Examiner*—Michael Cuff
*Assistant Examiner*—Hung Q Nguyen
(74) *Attorney, Agent, or Firm*—Thomas N. Twomey

(57) ABSTRACT

An injector mounting arrangement for use in an engine, the injector mounting arrangement including: a fuel injector having one or more resonant modes of vibration, an engine cylinder housing, and a clamping arrangement including a clamping member for applying a clamping load to the injector so as to clamp the injector to the cylinder housing wherein the clamping load is applied at or substantially at a vibration node of one of the one or more modes of vibration of the fuel injector so as to damp or substantially prevent transmission of injector generated noise to the cylinder housing.

12 Claims, 10 Drawing Sheets

INJECTOR MOUNTING ARRANGEMENT

TECHNICAL FIELD

The present invention relates to an injector mounting arrangement comprising at least one fuel injector for delivering fuel to an associated engine cylinder or combustion space. In particular, but not exclusively, the invention relates to an injector mounting arrangement for a common rail engine including a plurality of piezoelectrically operable fuel injectors.

BACKGROUND TO THE INVENTION

In known common rail fuel systems, a high pressure fuel pump is arranged to charge an accumulator volume in the form of a common rail with fuel at high pressure for delivery to a plurality of associated injectors. Each injector includes a valve needle which is movable by means of an actuator, towards and away from a valve seat, to control fuel injection through a plurality of injector outlets.

It is known to control valve needle movement by means of an electromagnetic actuator including a solenoid winding through which a current is passed to activate an armature. In turn, the armature controls a servo valve for controlling a control pressure applied to the valve needle and, hence, valve needle movement. It is also known, however, that particularly good injector performance can be achieved by using a piezoelectric actuator to drive movement of the valve needle. The piezoelectric actuator includes a stack of piezoelectric elements to which a voltage is applied to extend and contract the stack length. The actuator may be coupled directly to the valve needle so that, as the stack is retracted, the injector valve needle is caused to move with the stack retraction. Alternatively, the stack may be coupled to the valve needle via a motion amplifier (for example, a hydraulic amplifier). In other injectors the piezoelectric actuator controls valve needle movement indirectly through a servo valve.

One example of a piezoelectrically operable fuel injector is described in our granted European patent EP 0995901. Here, the piezoelectric actuator is coupled directly to the valve needle through a coupler having both hydraulic and mechanical coupling elements to provide variable amplification of movement of the valve needle.

Piezoelectric actuators provide a particular benefit over solenoid injectors as they are capable of generating high rates of force change which gives fast needle response. Injectors configured with direct acting piezoelectric actuators are particularly beneficial in this regard. However, one problem with using a direct acting piezoelectric actuator is that a greater mechanical force is required from the actuator in order to move the valve needle. Such high forces, and the associated high rates for force switching, are transmitted through the injector to the associated engine and result in an undesirable level of noise generation from the engine structure.

It is an object of the present invention to provide an engine in which the injectors can offer the benefits of a fast acting, high force actuator but in which the level of noise generation within the engine is substantially reduced.

SUMMARY OF INVENTION

According to a first aspect of the invention, there is provided an injector mounting arrangement for use in an engine, the injector mounting arrangement including: a fuel injector having one or more resonant modes of vibration, an engine cylinder housing, and a clamping arrangement including a clamping member for applying a clamping load to the injector so as to clamp the injector to the cylinder housing, wherein the clamping load is applied at or substantially at a vibration node of one of the one or more modes of vibration of the fuel injector so as to damp or substantially prevent transmission of injector generated noise to the cylinder housing.

It is noted that the fuel injector arrangement within an engine will vibrate as a result of the operation of the engine and, as such, can be thought of as a harmonic oscillator that exhibits a number of different modes of vibration. Each mode will have a corresponding characteristic frequency (the natural frequencies of the system) and the set of all such frequencies can be termed the normal mode spectrum. Such a spectrum constitutes a kind of "fingerprint" associated with any system capable of vibration.

The motion of the body of the fuel injector within an engine may include lateral vibrations, twisting or torsional vibrations and also axial vibrations along the length of the injector.

These characteristic vibrations will give rise to points/areas of minimal motion (nodal regions) which separate domains containing regions of maximal vibration (anti-node regions).

An injector body is essentially a thick walled pressure vessel and known injectors have geometries akin to bell like structures. Such geometries are undesirable since the interface between the cylinder head and the injector body will tend to undergo oscillations and thereby transmit noise to the cylinder housing.

The present invention recognises that the operation of the injector essentially causes the injector body to act as a driven or forced oscillator. In order to help minimise the effects of such injector generated noise the clamping load is arranged to be applied at or close to one of the vibration nodes (i.e. points of minimum motion) in order to damp or reduce the transmission of such noise into the rest of the engine structure.

It is recognised that the injector will exhibit a plurality of vibration modes. The clamping load is therefore applied to a vibration node of one of these vibration modes.

Preferably, the clamping load is arranged to be applied to a vibration node of the, or a dominant vibrational mode of the injector. This ensures that the noise damping is maximised.

Conveniently, conventional harmonic modal vibration analysis techniques can be used to determine the various vibration modes that the fuel injector exhibits. An example of a suitable analysis technique is finite element analysis.

An injector will generally comprise a main injector body which projects into a bore in the cylinder head of the engine. In prior art systems, the injector body is clamped to the cylinder head by a clamping arrangement that attaches at or close to one end of the generally elongate injector body, i.e. it is not clamped at the vibration node of one of the vibration modes of the system.

In order to clamp the injector to the main engine structure in accordance with the present invention, the mounting arrangement preferably comprises a clamping sleeve which extends over the injector such that the clamping load from the clamping arrangement is applied at the location of the chosen vibration node. Conveniently, the clamping sleeve comprises an annular sleeve that encloses the upper portion of the injector between the clamping arrangement and the vibration node.

Preferably, the injector comprises an actuator arrangement that controls the injection of fuel into the engine. Such an actuator controls a valve needle towards and away from a valve seat which thereby controls the injection of fuel through a plurality of injector outlets. The actuator may be an electromagnetic actuator including a solenoid winding through which a current is passed to activate an armature. Alternatively, a piezoelectric actuator, comprising a stack of piezoelectric elements to which a voltage is applied to extend and contract the stack length, may drive movement of the valve needle.

The operation of the actuator will effectively apply a driving force to the injector body, which is an harmonic oscillator. As the driving frequency approaches a natural frequency of the system resonance will occur thus resulting in the generation of noise. By clamping the injector body at a vibration node of the injector body in accordance with the first aspect of the present invention the noise that is transmitted to the main engine structure will be reduced.

The effect of vibrations within the system may be reduced further by optimising the geometry of the injector body so as to disperse vibration energy into a broader spectrum of frequencies. This will have the effect of reducing the vibration amplitudes present at the anti-node regions and will reduce the excitation forces to the cylinder head and reduce noise that is transmitted to the engine structure.

As noted above, injector body designs are bell like structures. By making the injector body less acoustically perfect than conventional injector body designs, the transmission of noise can be reduced further.

Conveniently, the main injector body can be shaped so as to reduce the transmission of injector generated noise.

For example, discontinuities may be introduced into the outer surface of the injector body so as to break up the modal response of the system and distribute the vibration energy into a broader range of frequencies. Conveniently, such discontinuities could be provided by stepped portions on the outer surface of the body. Grooves and/or ridges may also be incorporated into the injector design.

The modal response of the injector body may also be broken up by having a non-circular cross-section or alternatively, by tapering the diameter of the injector body along its length.

The transmission of noise to the main engine structure may be reduced still further by providing a decoupling material between the various interfaces between the injector, clamp and cylinder body.

For the purpose of this specification, a decoupling material is intended to mean one that not only decouples two parts from one another physically, but which suppresses noise transmission between the parts by virtue of its poor audible noise transmission properties. The decoupling material is selected as one which is a poor transmitter of sound (e.g. the speed of sound through the material is relatively low).

As the injector body and the clamping are separated from one another by decoupling material, and/or the cylinder housing and the clamping member are separated from one another by the decoupling material, the transmission of noise generated within the injector to the engine cylinder housing is substantially reduced due to the poor transmission of audible noise by the decoupling material. The invention provides a particular advantage in engines utilising piezoelectrically operable fuel injectors which require high actuation forces and high force switching rates (e.g. direct acting piezoelectric injectors). Equally, however, the present invention is applicable to engines utilising direct or indirect-acting piezoelectric injectors or electromagnetically operable fuel injectors.

The clamping arrangement may further include a clamping bolt which is received by the clamping fork and the cylinder housing to apply the clamping load to the injector.

The clamping bolt and the clamping member together define a clamp/bolt interface region, and a further decoupling material is provided in the clamp/bolt interface region to decouple the clamping member from the clamping bolt. For example, the further decoupling material may be located between a head of the bolt and a surface of the clamping member in the clamp/bolt interface region. Preferably, the further decoupling material is the same type of the material as the decoupling material in the clamp/cylinder interface region and/or the clamp/injector interface region.

The decoupling material at the or each interface region preferably takes the form of a washer, disc or other prefabricated part and is selected to have poor noise and/or vibration transmission properties. Suitable materials for use as the decoupling material are high grade filled engineering plastics (e.g. carbon fibre filled polyimide) or metallic solutions such as a manganese-copper alloy.

In an alternative embodiment to the clamping fork, the clamping arrangement may include an annular clamping member (e.g. a gland nut) through which a portion of the injector is received, wherein the annular member is received within the cylinder housing and defines, together with the injector or a part carried thereby (e.g. a clamping ring), the clamp/injector interface region. The clamp/injector interface region is provided with a decoupling material to decouple the annular clamping member from the injector or the part carried thereby (e.g. the clamping ring part). If the injector carries a clamping ring part, this clamping ring defines, together with the clamping member, the clamp/injector interface region.

According to a second aspect of the invention, there is provided a fuel injector for use in an engine comprising a main injector body, and a clamping region arranged in use to allow the injector to be mounted within an engine cylinder housing wherein the outer profile of the main injector body is shaped such that in use the transmission of injector generated noise is dampened or substantially prevented.

It will be appreciated that preferred and/or optional features of the first aspect of the invention may be provided in the second aspect of the invention also, alone or in appropriate combination.

BRIEF DESCRIPTION OF DRAWINGS

An embodiment of the present invention will now be described, by way of example only, with reference to the accompanying drawings in which.

DETAILED DESCRIPTION OF PREFERRED EMBODIMENTS

Figure 1:
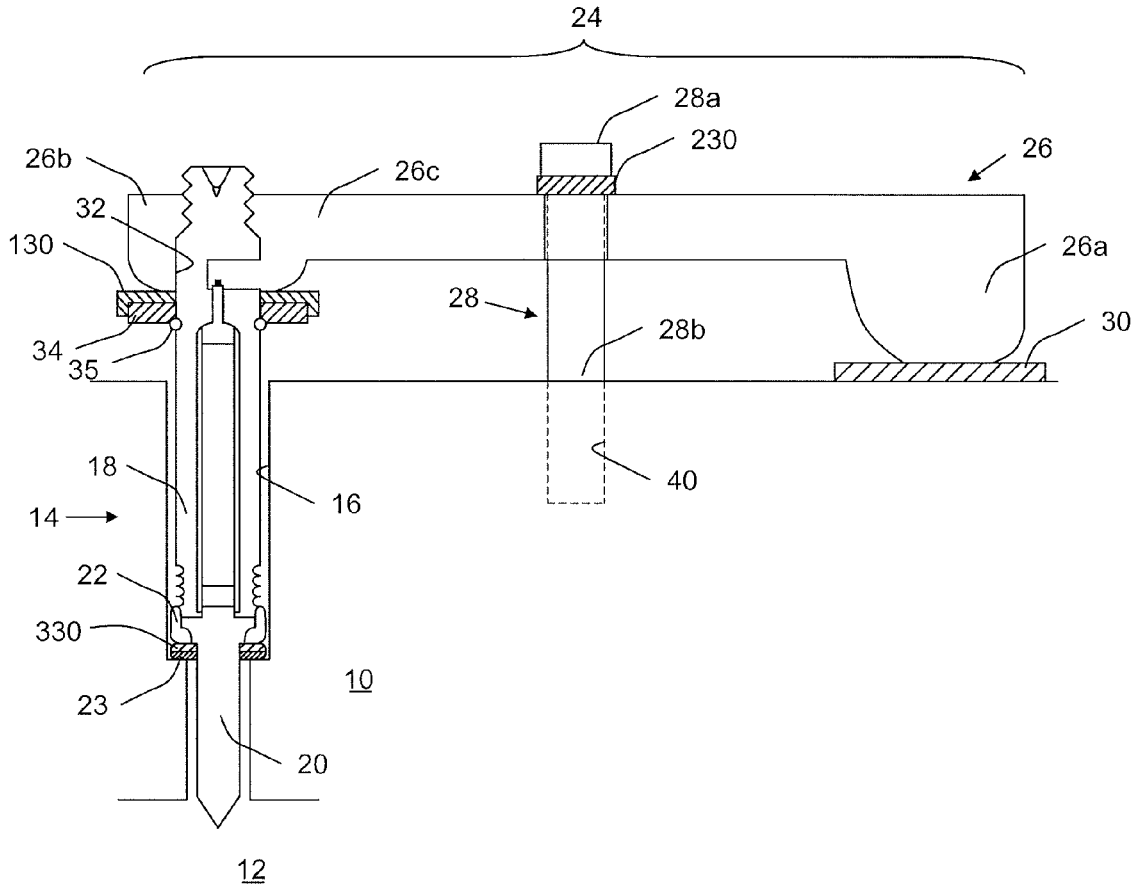
PRIOR ART FIGURE 1
FIG. 1 is a schematic diagram of a known injector mounting arrangement in accordance with a prior art arrangement.

Referring to FIG. 1, a known injector mounting arrangement is shown which includes an engine housing part in the form of an engine cylinder head 10 which defines a cylinder volume, or engine combustion space 12. The arrangement is provided with a plurality of fuel injectors 14, each of which is mounted within a respective opening or bore 16 provided in a respective cylinder head 10. Only one of the injectors is shown in FIG. 1 and only one will be described in detail as all of the injectors are substantially identical. One or more outlets (not shown) of the injector 14 projects into the cylinder volume 12 so as to permit injection of fuel for combustion.

The injector 14 typically takes the form of the piezoelectrically operable type including a piezoelectric actuator which is coupled, by means of a motion amplifier, to a fuel injector valve needle. The valve needle is moveable under the control of the actuator towards and away from a valve needle seat so as to control the injection of fuel through the injector outlets into the cylinder volume 12. The injector may be of the direct-acting type, for example as described in our granted European patent EP 0995901, or may be a servo-actuated piezoelectric injector. Alternatively, the injectors may be of the electromagnetically actuated type.

The injector 14 includes a main injector body 18 which projects through the uppermost end of the cylinder head bore 16. An injection nozzle 20 of the injector 14, which is provided with the injector outlets, projects through the lowermost end of the bore 16 into the cylinder volume 12. The injection nozzle 20 is mounted to the main injector body 18 by means of a cap nut 22, with a washer 23 carried on the injector body 18 between the cap nut 22 and the cylinder head 10. The underside of the cap nut 22 and the upper surface of the washer 23 together define what will be referred to as the cap nut/washer interface region.

As the engine undergoes a high level of vibration during operation it is necessary to ensure the injector 14 is mounted securely to the main engine structure. For this purpose a clamping arrangement, referred to generally as 24, is provided including a clamping member 26 and a clamping bolt 28. The clamping member 26 takes the form of a clamping fork having a first region at one end which defines a fork heel 26*a*, a second region at the other end which defines a fork nose 26*b* and an intermediate section 26*c* connecting the first and second regions 26*a*, 26*b*.

The fork heel 26*a* defines, together with an upper surface of the cylinder head 10, a clamp/cylinder interface region between the clamping fork 26 and the cylinder head 10 which is provided with a decoupling member formed from a sample 30 of decoupling material. The decoupling material 30 spaces apart the fork heel 26*a* and the cylinder head 10 so that they are isolated from one another (i.e. the decoupling material 30 is sandwiched between the fork heel and the cylinder head surface).

At the other end of the clamping fork 26, the main injector body 18 extends into a first drilling or through bore 32 provided in the fork nose 26*b*. The main injector body 18 carries a clamping ring 34 which bears on a circlip 35 located within an annular groove provided on the injector body 18. An upper surface of the clamping ring 34 defines, together with the underside of the fork nose 26*b*, a clamp/injector interface region between the ring 34 and the injector 14. The clamping ring 34 forms a separate part from the injector body 18 in the illustration shown, but equally may form an integral part of the injector body 18 itself. In another variation, the circlip 35 may be removed and instead the injector body 18 may be provided with a step or other projection for the clamping ring 34 to bear against.

The clamp/injector interface region is provided with a decoupling member in the form of a sample 130 of decoupling material, preferably the same material as the decoupling material 30 in the clamp/cylinder interface region, so that the clamping ring 34 and the fork nose 26*b* are isolated from one another (i.e. the decoupling material 130 is sandwiched between the fork nose and the clamping ring).

The intermediate section 26*c* of the clamping fork 26 is provided with a drilling or through bore 36 for receiving a stem 28*b* of the clamping bolt 28 so that a bolt head 28*a* projects through one side of the drilling 36 and the bolt stem 28*b* projects through the other side of the drilling 36. The end of the stem 28*b* remote from the bolt head 28*a* extends into a further drilling 40 provided in the upper surface of the cylinder head 10 so that, as the bolt 28 is tightened into the drilling 40, a clamping load is applied to the injector 14 at the clamp/injector interface region to clamp the parts together. An interface region between the underside of the clamping bolt head 28*a* and the upper surface of the clamping fork 26 (referred to as the clamp/bolt interface region) is also provided with a sample 230 of decoupling material, which isolates the clamping bolt head 28*a* from the clamping member 26 so that the two parts do not make contact. A washer (not shown) is also provided in the clamp/bolt interface region in a conventional manner. Preferably, the sample 230 of decoupling material at the clamp/bolt interface is of the same material as the samples 130, 30 at the clamp/injector and clamp/cylinder interface regions.

In addition to the decoupling material provided at the clamp/injector, clamp/cylinder and clamp/bolt interface regions, a sample 330 of decoupling material may be introduced at the interface region between the cap nut 22 and the washer 23 in the cap nut/washer interface region. The way in which the injector 14 mounts to the engine structure is shown in schematic form in FIG. 2.

Figure 2:
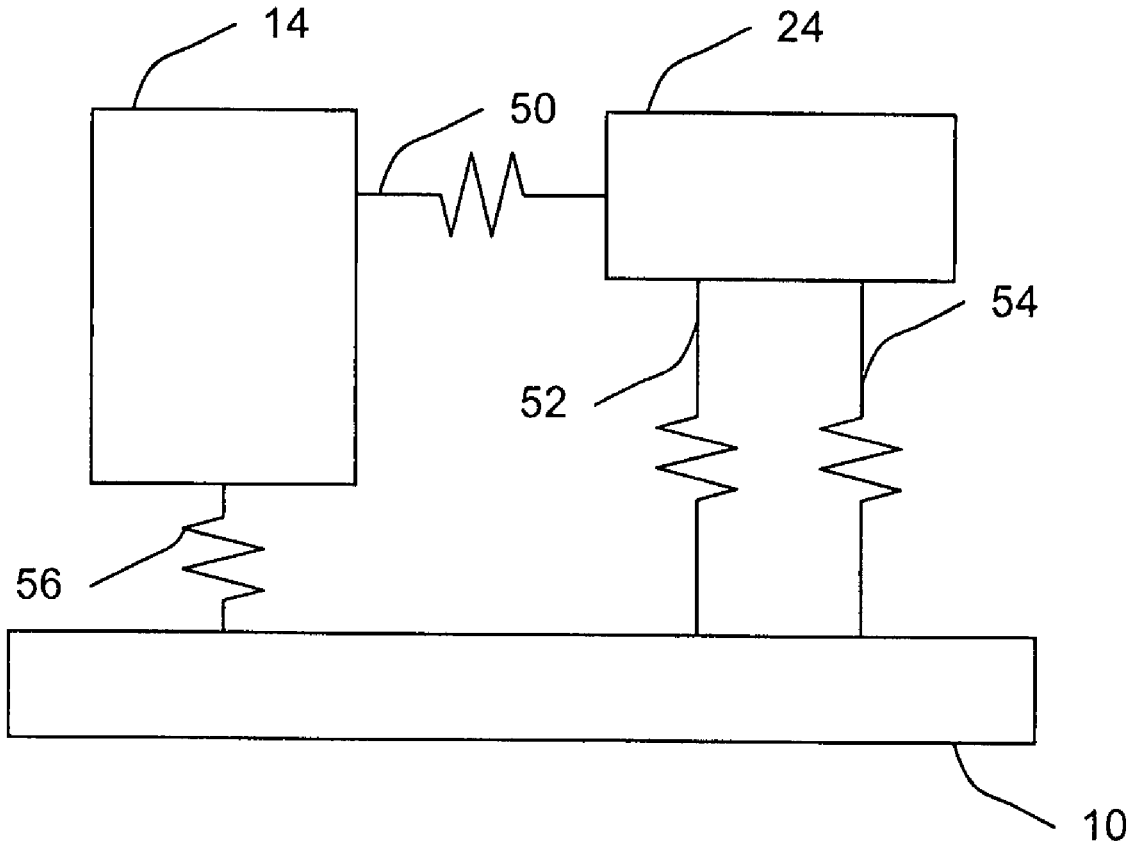
FIG. 2 is a schematic diagram to illustrate the possible noise transmission paths between the injector, the engine cylinder head and the clamping arrangement for the mounting arrangement in FIG. 1.

The decoupling material provided at each of the interface regions is selected to be a material having poor noise transmission at audible frequencies. Any material for which the speed of sound in the material is relatively low is suitable i.e. any material having a relatively high density and a relatively low stiffness compared with that of the interfacing components. It is also preferable for the decoupling material to have good thermal stability, good fretting resistance, good creep resistance and good compressive strength. By way of example, a reinforced composite material made from metal fibres and a phenolic matrix may be used (for example, brake pad material). Alternatively, a chopped carbon fibre filled polyimide or manganese-copper alloy may be used. During engine operation, due to the high mechanical forces generated by the piezoelectric actuator and the high rate of force switching, the injector 14 generates a reasonably high degree of audible noise. In a conventional engine set-up this noise is transmitted through the interface regions between the clamping member and the injector, and/or between the injector and the cylinder head and/or between the clamping member and the cylinder head, causing injector generated noise to be propagated through the cylinder head to the main engine structure (e.g. as illustrated by FIG. 2). In the mounting arrangement of FIG. 1, however, noise transmission is suppressed due to the provision of the decoupling material at one or more of the key interface regions in the load paths; the clamp/injector interface region, the clamp/cylinder interface region, the clamp/bolt interface region and/or the injector/cylinder interface region. In this way a high proportion of the sound energy generated by the injector is absorbed by the decoupling material. In addition, vibration transmission is reduced due to the injector, clamp and cylinder parts being isolated from one another physically.

The decoupling material at the various interfaces takes the form of a pre-fabricated piece which is received at the desired location during mounting of the injector 14 to the cylinder head 10. For example, the decoupling material at the clamp/bolt interface and the clamp/injector interface may take the form of an annular member or washer. The sample of decoupling material 30 at the clamp/cylinder interface may be provided with a recess to locate the fork heel 26*a* or, in an alternative embodiment, the sample 30 may itself form an integral part of the fork 26.

It is noted that our co-pending European patent application 05255732.9 describes the clamping arrangement of FIG. 1.

FIG. 2 illustrates the various mountings between the injector 14 and the engine structure 10. As shown in FIG. 2 (and described in relation to FIG. 1 above) there are four main interface regions, the fork (24)/injector (14) interface 50, the bolt (28)/cylinder head (10) interface 52, the fork (24)/cylinder head (10) interface 54 and the injector (14)/cylinder head (10) interface 56. Each of the four interfaces 50, 52, 54, 56 allow noise transmission throughout the injector assembly.

The presence of the damping material 30, 130, 230, 330 helps to reduce the generation of noise relative to a clamping arrangement that does not utilise damping materials. However, there may still be an undesirable level of noise transmission from the engine structure.

In piezoelectrically actuated fuel injectors noise is generated by two main mechanisms, (i) from the piezoelectric element itself as the length of the stack of piezoelectric elements changes with varying applied voltage and (ii) from the amplifier arrangement for transmitting movement of the piezoelectric actuator arrangement to the injector valve member.

Figure 3A:
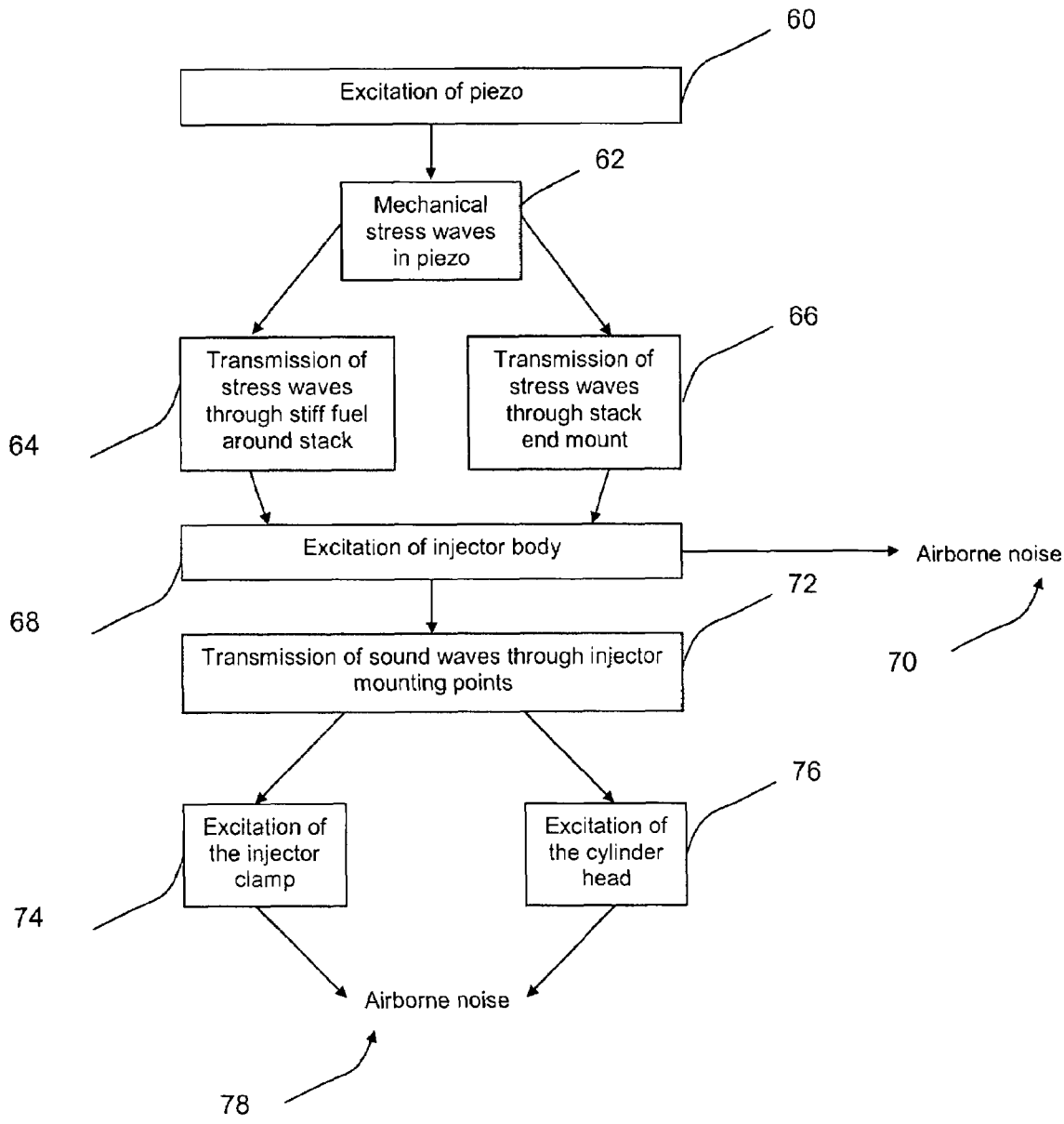
FIGS. 3*a* and 3*b* are flow charts illustrating noise generation mechanisms in relation to the clamping arrangement of FIG. 1 and the transmission paths of FIG. 2.
Figure 3B:
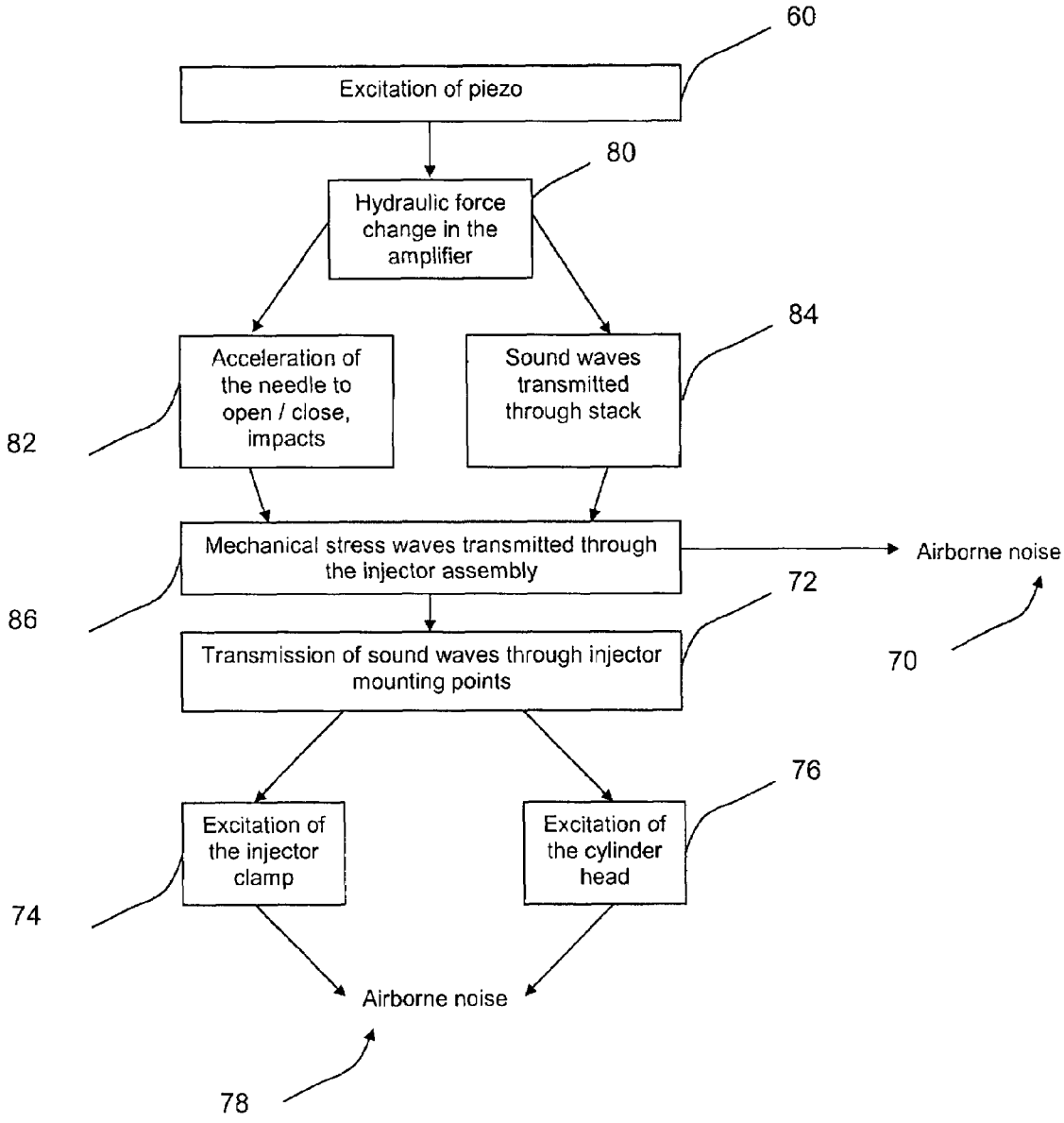

FIGS. 3*a* and 3*b* illustrate the various noise transmission paths for the two noise generation mechanisms above.

FIG. 3*a* shows the noise transmission arising from excitation of the piezoelectric element.

Initially, at step 60, the piezoelectric element is excited. This results in mechanical stress waves within the stack of piezoelectric elements (step 62). The stress waves from step 62 are either transmitted through fuel surrounding the piezoelectric elements (step 64) or via the mounting points of the piezoelectric elements within the injector (step 66) which causes the injector body 14 to vibrate (step 68) and generate noise (step 70).

As noted in relation to FIG. 2 there are a number of interfaces which allow the noise to propagate. In step 74, noise propagates via the fork/injector interface 50 to generate noise in the engine block. In step 76, noise propagates via the other various interfaces 52, 54, 56 to generate noise.

The noise generated by the piezoelectric excitation is generally in the range 6-12 kHz.

FIG. 3*b* shows the noise transmission arising from changes in the amplifier arrangement. As the piezoelectric element is excited (step 60) the forces acting on the amplifier arrangement change (step 80).

The injector nozzle is provided with a blind bore within which a valve needle or valve member 12 is slidable. The end of the valve needle is engageable with a valve seating defined by the blind end of the bore to control fuel delivery through outlet openings (not shown), provided in the nozzle body 10.

The amplifier means is arranged to open and close the valve needle in response to changes in the piezoelectric stack. The impacts caused by the opening/closing of the needle (step 82) cause mechanical stress waves to be transmitted through the injector assembly (step 86). Sound waves will also be transmitted through the piezoelectric stack (step 84).

The mechanical stress waves from step 86 results in airborne noise 87. The stress waves are also transmitted through the injector mounting points (step 72) as described in relation to FIG. 3*a* above. Further noise 78 therefore results from excitation of the injector clamp (74) and cylinder head (76).

It is noted that noise generated via the amplifier arrangement within the fuel injector is in the region of 1-6 kHz.

Figure 4A:
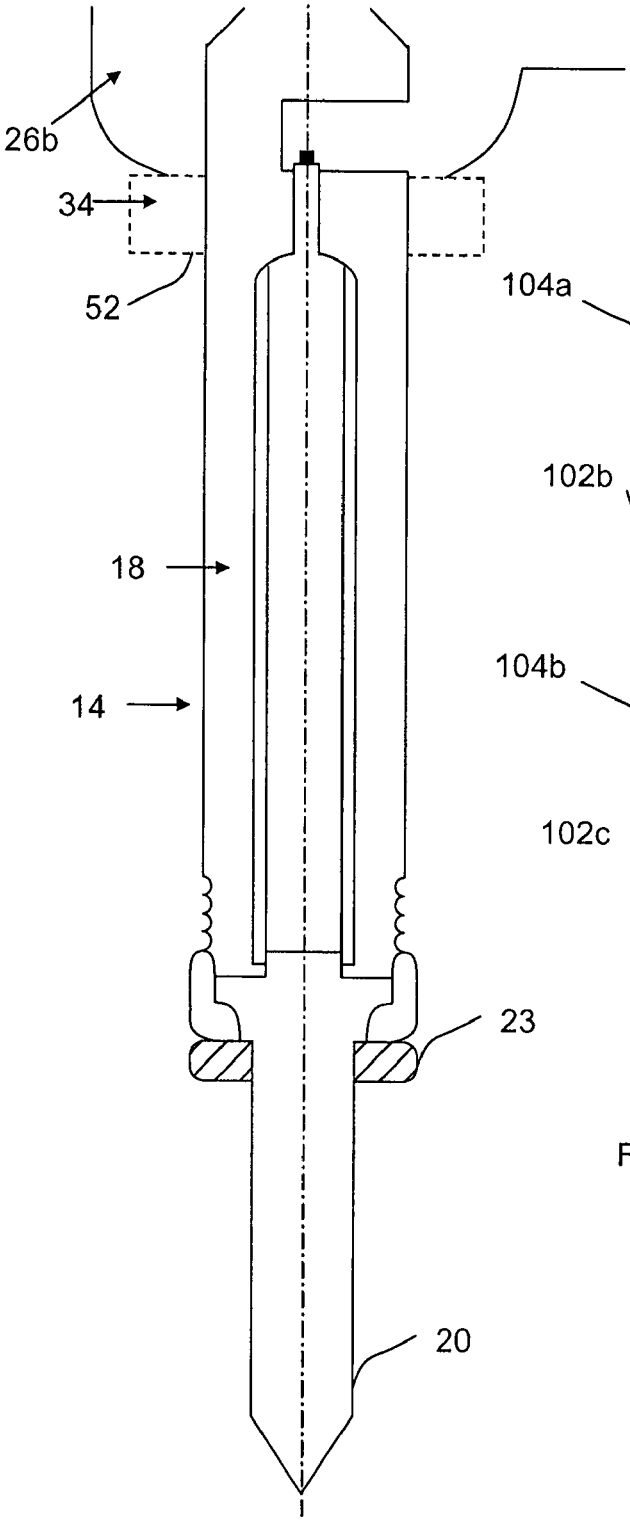
FIG. 4*a* is a schematic diagram showing an example of a known clamping ring position present in an injector mounting arrangement.

FIG. 4*a* shows a known injector mounting arrangement similar to that of FIG. 1. Like features between FIGS. 1 and 4 are denoted by like numerals.

FIG. 4*a* shows an injector 14 having a main body 18. The injector 14 is mounted in a cylinder head (not shown in FIG. 4*a*) by means of a clamping member, one end 26*b* of which is shown in the Figure. A washer 23 provides the interface between the injector 14 and the cylinder block. A clamping ring 34 bears on the injector body 18 and secures the injector 14 to the clamping means 26.

As noted above there are a number of mechanisms by which noise can be generated and transmitted within the engine block. Vibration of the injector and injector mounting assembly is one way in which noise can be generated.

Figure 4B:
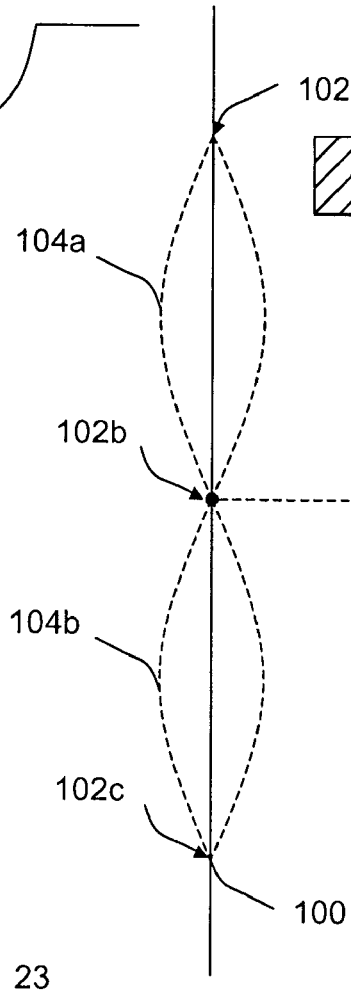
FIG. 4*b* is an illustration of a typical vibrational mode experienced in use by the mounting arrangement of FIG. 4*b;*

FIG. 4*b* shows an example of a possible mode 100 of vibration of the injector body 18 that may develop during engine use. The vibration mode 100 is shown displaced horizontally from the injector 14 of FIG. 4*a* for the sake of clarity.

The vibration mode 100 depicted comprises a number of vibration nodes 102*a*, 102*b*, 102*c* and a number of vibration anti-nodes 104*a*, 104*b*.

It can be seen that the clamping ring 34 is not in an optimised position in relation to this vibration mode and so will experience vibration generated forces during operation of the engine.

The present invention seeks to optimise the mounting point of the clamping ring such that it is located at a vibration node of the injector body 18.

Figure 4C:
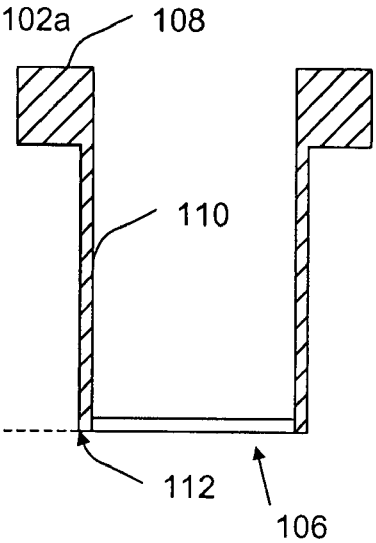
FIG. 4*c* is a schematic diagram to illustrate the mounting arrangement according to an embodiment of the present invention.

FIG. 4*c* shows a clamping ring 106 in accordance with the present invention. The clamping ring 106 comprises an upper portion 108 which is similar in profile to the clamping ring 34. The upper portion 108 allows the clamping ring to connect to the clamping means 26.

The clamping ring 106 further comprises an extended sleeve portion 110 which, in use, extends over the surface of the injector body 18. The bottom portion 112 of the ring 106 is located at the same position as the vibration node 102*b* of the vibration mode 100. The injector 14 is therefore clamped by the ring 106 at the position of the vibration node.

In use, the extended clamping ring 106 minimises transmitted noise between the clamping means and the injector.

FIG. 4*b* shows only a single mode of vibration. In practice, there will be a plurality of vibration modes and the dominant mode of vibration can be determined by conventional harmonic modal vibration analysis techniques. The clamping ring 106 can be designed to clamp the injector body at a vibration node of this dominant mode of vibration.

FIGS. 5*a* to 5*e* are schematic illustrations of embodiments of further aspects of the present invention in which the outer profile of the main injector body 18 has been modified to reduce the transmission of noise within the engine.

Figure 5A:
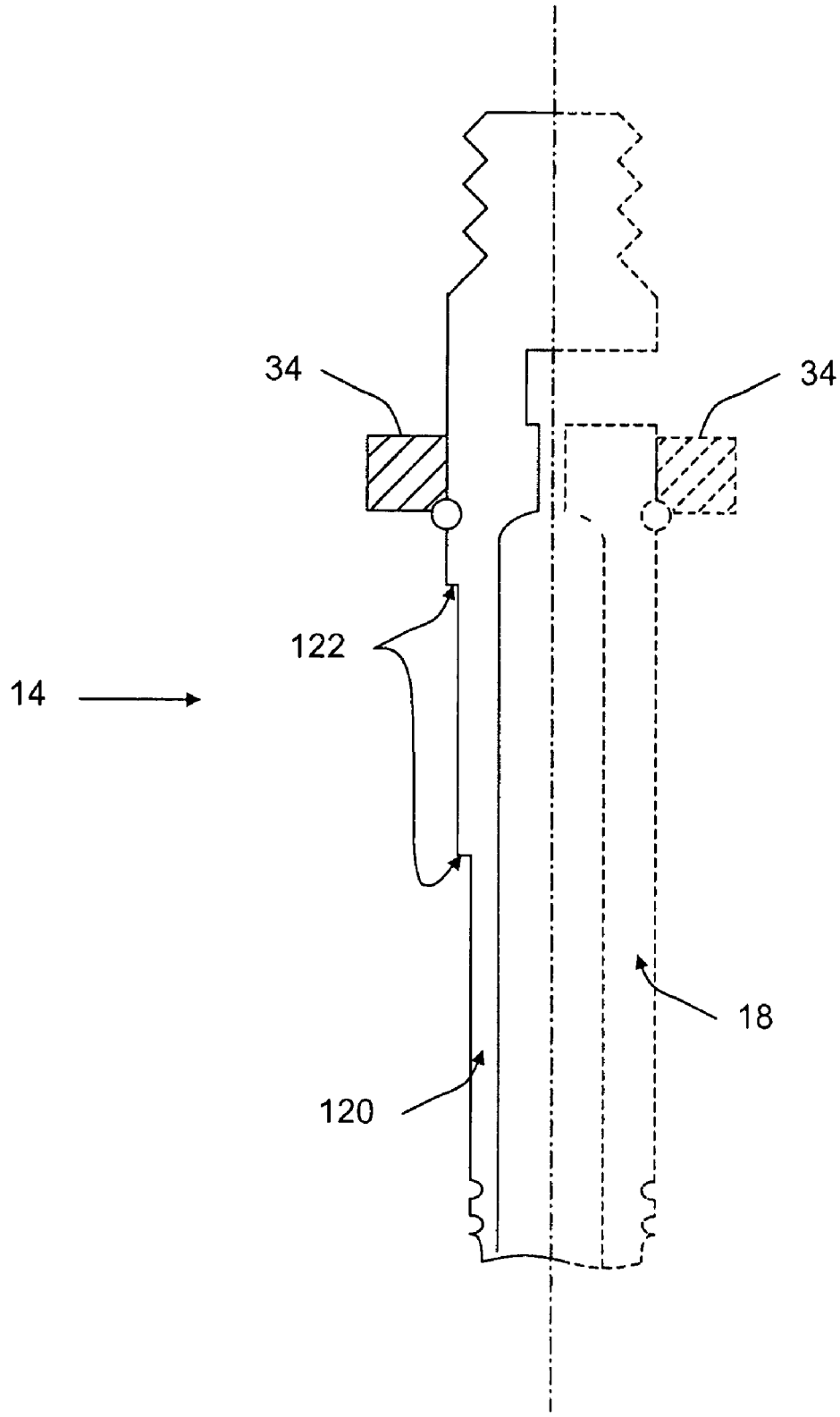
FIGS. 5*a* to 5*e* are schematic diagrams illustrating embodiments of further aspects of the present invention.
Figure 5B:
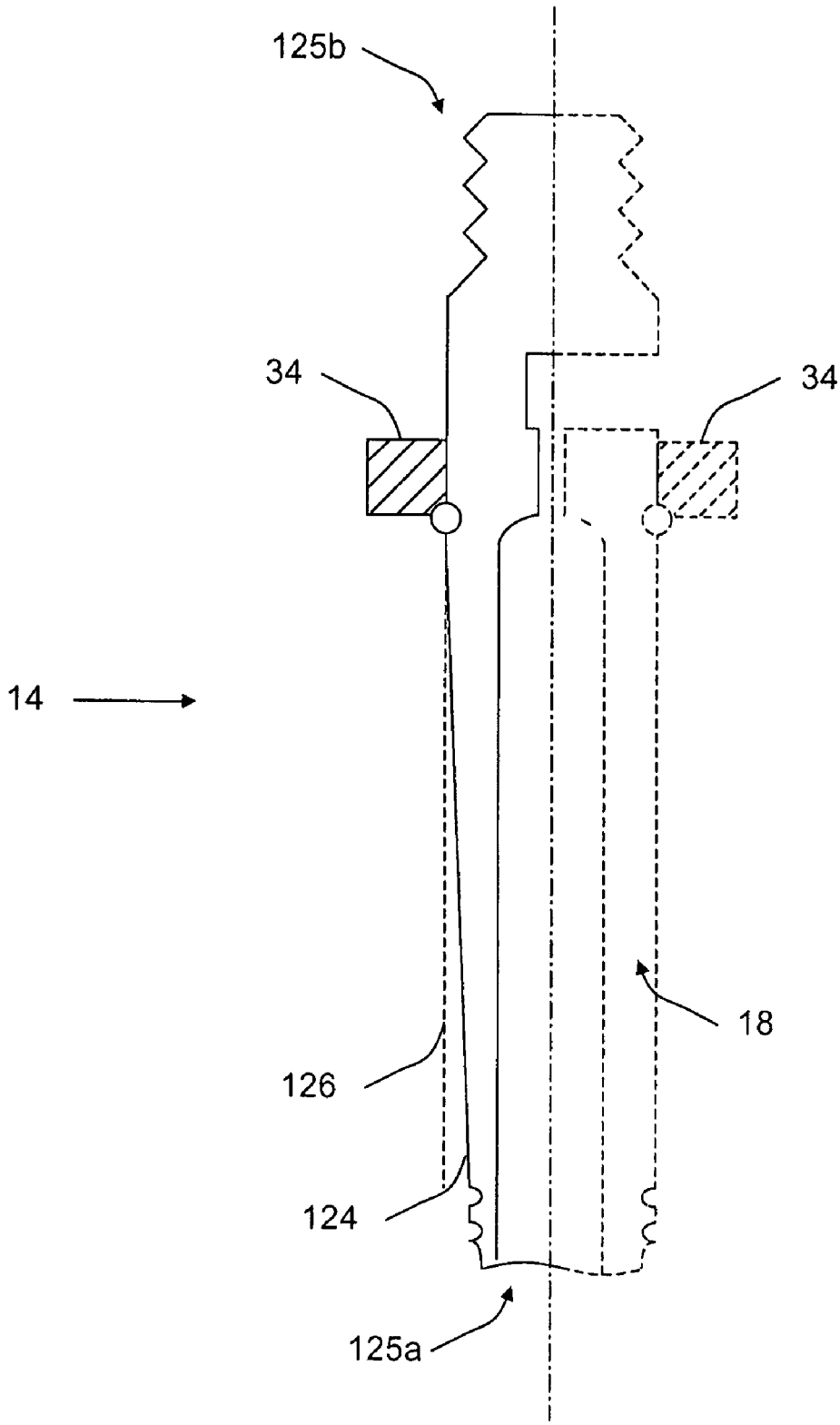

With respect to FIGS. 5*a* and 5*b*, it is noted that the left hand side of FIGS. 5*a* and 5*b* shows the profile of the injector body in accordance with an embodiment of the present invention. The right hand side of each of these Figures shows, by way of comparison, the profile of a known injector (as depicted in FIGS. 1 and 4*a*).

Like numerals have been used to denote like features with earlier Figures.

FIG. 5*a* shows an embodiment of an aspect of the present invention in which the outer profile 120 of the body 18 of the injector 14 comprises a number of steps 122. These stepped portions break up the modal response of the injector and distribute the vibrational energy into a broader range of frequencies.

An alternative profile for an injector 14 in accordance with an aspect of the present invention is depicted in FIG. 5*b*. The injector body 124 in this example is tapered such that it is narrower at the nozzle end 125*a* of the injector body compared to the clamping end 125*b*. The normal profile of the injector body is depicted by the dotted line 126.

Figure 5C:
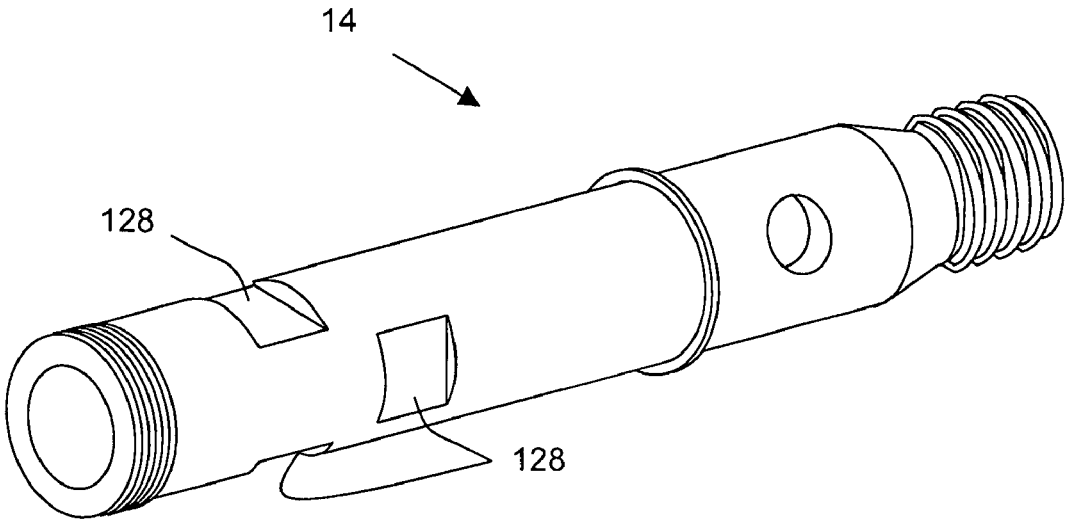

A further alternative profile for an injector in accordance with an aspect of the present invention is depicted in FIG. 5*c*. In this example, the injector body comprises a number of flattened regions 128.

Figure 5D:
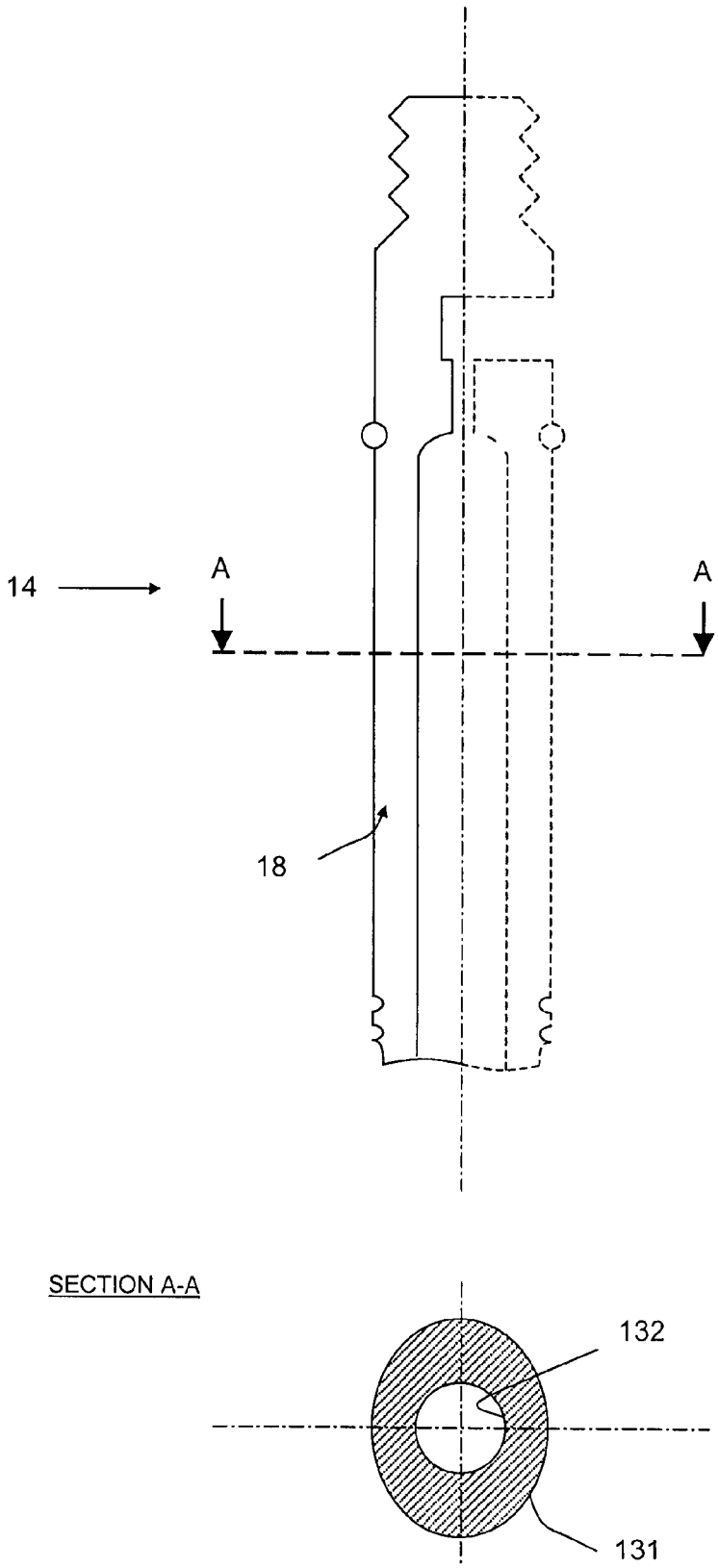

A yet further alternative profile for an injector in accordance with an aspect of the present invention is depicted in FIG. 5*d*. The outer profile of the injector body 18 in FIG. 5*d* is of non-circular cross section. This can clearly be seen in the section along the line A-A. The outer profile 131 is non-circular. The inner bore 132 of the injector body is circular.

Figure 5E:
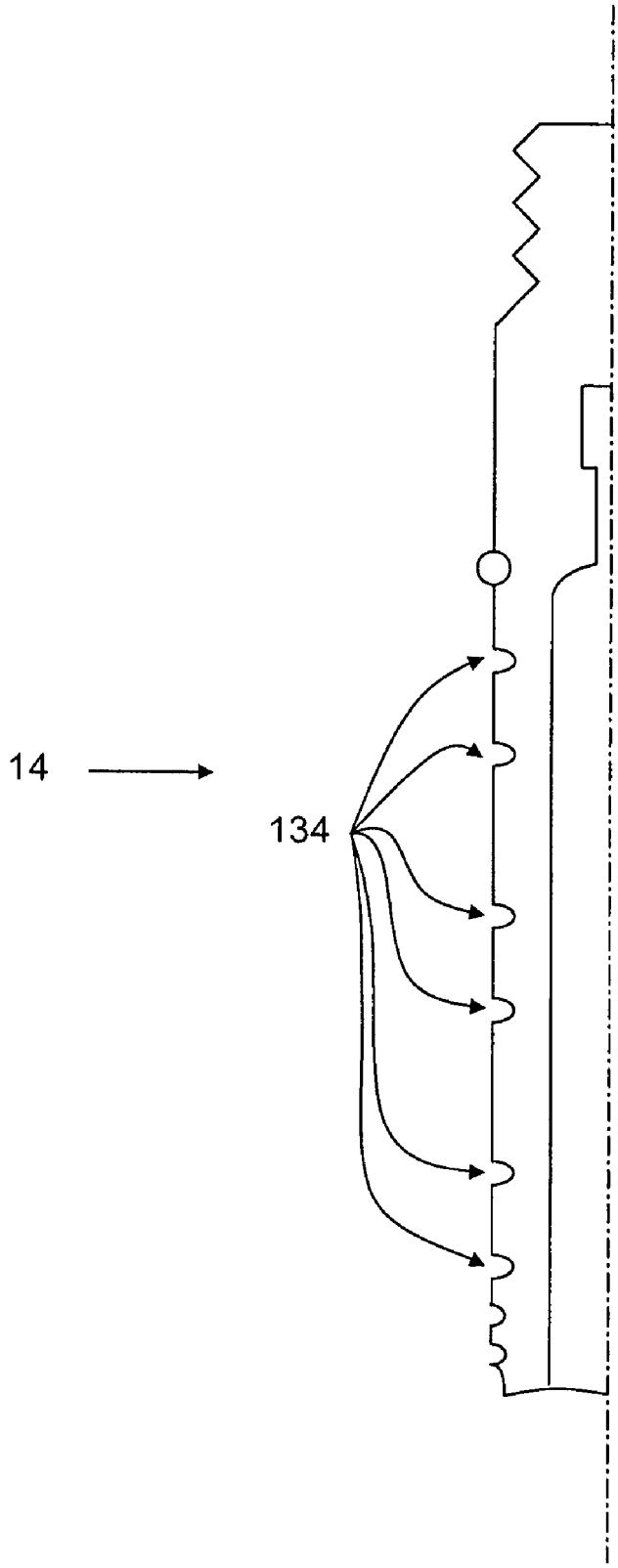

A still further alternative profile for an injector in accordance with an aspect of the present invention is depicted in FIG. 5*e*. In this example the injector body is provided with a number of grooves 134 in its outer profile. In a preferred embodiment the grooves 134 appear at irregular intervals on the outer profile of the injector body. As an alternative the injector body may comprise a number of ridges.

In each of FIGS. 5*a* to 5*e* the outer profile of the main body of the injector has been modified such that the modal response of the injector is broken up into a broader range of frequencies compared to the modal response of the injector depicted in FIG. 1. The injectors of FIGS. 5*a* to 5*e* are less acoustically perfect than the known injector design shown in FIG. 1 and dissipate energy arising from vibrations etc.

It will be appreciated that various modifications of the embodiments described previously are also possible whilst still falling within the scope of the invention as set out in the claims. For example, the decoupling material need not be provided at every interface location, and an adequate reduction in noise transmission may be achieved by providing the material at just one or two locations. Other mounting arrangements for the injector are also envisaged, as would be familiar to persons skilled in this field of technology, and it will be appreciated that the use of the decoupling material in accordance with the invention is equally applicable to these arrangements also.

It is also noted that the embodiments described in relation to FIGS. 5*a* to 5*e* may be provided in combination with the embodiment of FIG. 4*c* or alternatively may used with a known clamping ring arrangement.

The invention claimed is:

1. An injector mounting arrangement for use in an engine, the injector mounting arrangement including:

a fuel injector having one or more resonant modes of vibration, an engine cylinder housing, and a clamping arrangement including a clamping member for applying a clamping load to the injector so as to clamp the injector to the cylinder housing, wherein the clamping load is applied at a point at or substantially at a vibration node of one of the one or more modes of vibration of the fuel injector so as to damp or substantially prevent transmission of injector generated noise to the cylinder housing, wherein the clamping member applies the clamping load to the injector through a clamping sleeve which extends over part of the fuel injector, and wherein the clamping member is located at one end of the injector and the clamping sleeve extends from the clamping member to the vibration node.

2. An injector mounting arrangement as claimed in claim 1, wherein the fuel injector in use has a dominant mode of vibration and the clamping load is applied at a vibration node of the dominant mode of vibration.

3. An injector mounting arrangement as claimed in claim 1, wherein the injector comprises an actuator arrangement for controlling the injection of fuel.

4. An injector mounting arrangement as claimed in claim 1, wherein the injector comprises an injector body, a tip region disposed at a first end of the injector body, and a clamping region for receiving the clamping load from the clamping arrangement.

5. An injector mounting arrangement as claimed in claim 4, wherein the injector body comprises discontinuities on its outer surface.

6. An injector mounting arrangement as claimed in claim 4, wherein the injector body comprises stepped portions on its outer surface.

7. An injector mounting arrangement as claimed in claim 4, wherein the injector body has a non-circular cross section.

8. An injector mounting arrangement as claimed in claim 4, wherein the injector body comprises grooves or ridges in or on its outer surface.

9. An injector mounting arrangement as claimed in claim 4, wherein the injector body is substantially elongate and the outer surface of the injector body is tapered along its elongate length.

10. An injector mounting as claimed in claim 1, wherein a decoupling material is provided between at least one of the interface between the clamping member and the cylinder housing and the interface between the clamp and the injector to decouple, respectively, the clamping member from the cylinder housing and/or the clamping member from the injector so as to damp or substantially prevent transmission of injector generated noise to the cylinder housing.

11. An injector mounting arrangement as claimed in claim 10, wherein the decoupling material is substantially formed from one of: metal tilled phenolic resin, carbon fibre filled polyimide, manganese-copper alloy or filled high grade plastics.

12. An injector mounting arrangement for use in an engine, the injector mounting arrangement including:

a fuel injector having one or more resonant modes of vibration;

an engine cylinder housing;

a clamping arrangement including a clamping member for applying a clamping load to the injector so as to clamp the injector to the cylinder housing; and a clamping ring including a sleeve portion which extends over the injector such that the clamping load from the clamping arrangement is transmitted through the sleeve portion and applied at a point at or substantially at a vibration node of one of the one or more modes of vibration of the fuel injector so as to damp or substantially prevent transmission of injector generated noise to the cylinder housing.

* * * * *